US006539854B2

(12) United States Patent
Maeda et al.

(10) Patent No.: US 6,539,854 B2
(45) Date of Patent: Apr. 1, 2003

(54) STENCIL PRINTER

(75) Inventors: Yukihiro Maeda, Ibaraki-ken (JP); Hirohide Hashimoto, Ibaraki-ken (JP)

(73) Assignee: Riso Kagaku Corporation, Tokyo (JP)

( * ) Notice: Subject to any disclaimer, the term of this patent is extended or adjusted under 35 U.S.C. 154(b) by 0 days.

(21) Appl. No.: 09/907,701

(22) Filed: Jul. 19, 2001

(65) Prior Publication Data

US 2002/0011158 A1 Jan. 31, 2002

(30) Foreign Application Priority Data

Jul. 21, 2000 (JP) ..... 2000-220040

(51) Int. Cl.[7] ..... B41L 13/00
(52) U.S. Cl. ..... 101/118; 101/232
(58) Field of Search ..... 101/116, 117, 101/118, 129, 183, 232, 484, 485; 271/10.03, 114, 258.01, 265.01

(56) References Cited

U.S. PATENT DOCUMENTS 5,222,724 A * 6/1993 Hirano et al. ..... 271/10.11
5,701,573 A * 12/1997 Yoshiuchi et al. ..... 399/384
5,979,311 A * 11/1999 Kakurai et al. ..... 101/118
6,098,536 A * 8/2000 Ohkawa ..... 101/116

* cited by examiner

*Primary Examiner*—Ren Yan
(74) *Attorney, Agent, or Firm*—Nixon Peabody LLP; Donald R. Studebaker

(57) ABSTRACT

A stencil printer includes a printing drum which is rotated bearing a stencil wound around the printing drum, a pair of paper feed rollers which are rotated in contact with each other to supply a printing paper to the printing drum, and a press roller which is rotated in contact with the printing drum to convey the printing paper supplied to the printing drum with the printing paper pressed against the stencil on the printing drum. A paper feed roller driver drives the paper feed rollers, and a paper feed roller controller controls the paper feed roller driver to rotate the paper feed rollers at a peripheral speed higher than that of the printing drum at least from the time the leading end of the printing paper reaches the printing drum to the time the trailing end of the printing paper passes the paper feed rollers.

4 Claims, 10 Drawing Sheets

STENCIL PRINTER

BACKGROUND OF THE INVENTION

1. Field of the Invention

This invention relates to a stencil printer, and more particularly to a stencil printer which prints by the use of a stencil wound around a printing drum.

2. Description of the Related Art

There has been known a stencil printer in which printing papers are inserted into between a rotating printing drum around which a stencil is wound and a press roller which is rotated in contact with the printing drum under a pressure, and ink supplied inside the printing drum is transferred to the printing papers through the perforations in the stencil.

The printing papers are generally fed to the printing drum by primary and secondary paper feed sections which are driven by the printing drum by way of a driving mechanism employing gears and the like. The primary and secondary paper feed sections are controlled so that each of the printing papers is accurately positioned with respect to the stencil on the rotating printing drum.

In the primary paper feed section, printing papers on a paper feed table are fed out one by one, one each time the printing drum makes a rotation, by a pickup roller and a scraper roller. The pickup roller has a friction member coaxially fixed to a shaft which is intermittently rotated in response to engagement and disengagement of a paper feed clutch. Then the printing papers are transferred to the secondary paper feed section. The pickup roller and the scraper roller are provided with a one-way clutch and when the paper feed clutch is disengaged after the printing paper is delivered to the secondary paper feed section, the pickup roller and the scraper roller are rotated driven by way of the printing paper, thereby reducing the back tension.

In the secondary paper feed section, the leading end of the printing paper abuts against the contact line of a guide roller and a timing roller (the two rollers will be referred to as "the paper feed roller pair", hereinbelow) which are stopped or a surface of the paper feed roller pair near the contact line. After the printing paper is thus provided with sag, the paper feed roller pair are started at a predetermined angular position of the printing drum. The paper feed roller pair are in mesh with each other at their ends and the guide roller is drivingly connected to a main motor by way of a driving force transmitting means such as gears, an endless belt and the like. The guide roller is arranged to make a predetermined number of rotations per one rotation of the printing drum by a mechanism including a cam, a sector gear, a one-way clutch and the like. The timing roller is driven by the guide roller in the reverse direction. The timing roller is arranged to be moved away from the guide roller after the printing paper is delivered to the printing drum and the guide roller is stopped by a mechanism including a cam, a cam follower, a link, a resilient member and the like. A spring, an electromagnetic brake and the like are provided on one end portion of the timing roller in order to suppress the delay between disengagement of the timing roller from the guide roller and stop of the guide roller due to inertia.

The printing paper delivered to the printing drum by the paper feed roller pair is pressed against the stencil on the printing drum under a predetermined pressure by the press roller and ink supplied by an ink supply section disposed inside the printing drum is transferred to the printing paper through the perforations in the stencil, whereby a print is made.

Conventionally, the paper feed roller pair are arranged to be opened, that is, to be moved away from each other, just at the time, the leading end portion of the printing paper comes to be pinched by the printing drum and the press roller (i.e., the printing papers comes to be driven by the printing drum and the press roller) which are rotating. This involves the following problems.

When the paper feed roller pair are prematurely opened just before the leading end portion of the printing paper comes to be pinched by the printing drum and the press roller while a trailing end portion of the printing paper is still in the primary paper feed section, the primary paper feed section, that is, the pickup roller, the scraper roller and the like, applies back tension to the printing paper, which can result in stretch of the stencil (which causes stretch of printed image generally called "ghost") or displacement of the stencil. To the contrast, when the paper feed roller pair are opened after the leading end portion of the printing paper comes to be pinched by the printing drum and the press roller, the paper feed roller pair apply back tension to the printing paper, which can also result in ghost and/or displacement of the stencil.

Accordingly, it has been necessary to highly accurately control the timing of opening the paper feed roller pair, which adds to the cost of the stencil printer.

Further, when the paper feed roller pair are opened and closed, noise is generated.

Further, printing papers vary widely in thickness and the paper conveying rate of the paper feed roller pair for a given speed of the paper feed roller pair varies according to the thickness of the printing paper, which makes it necessary to change the timing of opening the paper feed roller pair according to the thickness of the printing paper. Further, depending on the material of the paper feed roller pair, the diameter of the paper feed roller pair changes with the temperature of the environment. When the diameter of the paper feed roller pair changes, the paper conveying rate of the paper feed roller pair for a given speed of the paper feed roller pair varies, which makes it necessary to change the timing of opening the paper feed roller pair according to the temperature of the environment.

SUMMARY OF THE INVENTION

In view of the foregoing observations and description, the primary object of the present invention is to provide a stencil printer in which generation of ghost can be suppressed without accurately controlling the timing of opening the paper feed roller pair, whereby the cost can be reduced.

Another object of the present invention is to provide a stencil printer in which the printing papers can be stably conveyed irrespective of the thickness of the printing papers or the temperature of the environment without necessity of accurately controlling the timing of opening the paper feed roller pair.

Still another object of the present invention is to provide a stencil printer which can prevent generation of noise due to opening and closing of the paper feed roller pair.

The stencil printer in accordance with the present invention comprises

- a printing drum which is rotated bearing a stencil wound around the printing drum,
- a pair of paper feed rollers which are rotated in contact with each other to feed a printing paper inserted therebetween and supply it to the printing drum,
- a pressing roller means which is rotated in contact with the printing drum to convey the printing paper supplied to the printing drum with the printing paper pressed against the stencil on the printing drum, a paper feed roller drive means which drives the paper feed rollers, and a paper feed roller control means which controls the paper feed roller drive means to rotate the paper feed rollers at a peripheral speed higher than that of the printing drum at least from the time at which the leading end of the printing paper reaches the printing drum to the time at which the trailing end of the printing paper passes the paper feed rollers.

It is preferred that the paper feed roller control means be provided with a speed changing means which controls the paper feed roller drive means to change the peripheral speed of the paper feed rollers.

For example, the speed changing means may control the paper feed roller drive means to change the peripheral speed of the paper feed rollers according to the paper conveying rate of the paper feed rollers.

The speed changing means may be provided with a sag detecting means which detects the amount of sag of the printing paper between the paper feed rollers and the printing drum and may control the paper feed roller drive means to change the peripheral speed of the paper feed rollers according to the amount of sag.

In the stencil printer of the present invention, since the paper feed rollers are rotated at a peripheral speed higher than that of the printing drum at least from the time at which the leading end of the printing paper reaches the printing drum to the time at which the trailing end of the printing paper passes the paper feed rollers, the printing paper is conveyed with sag formed between the paper feed roller pair and the printing drum. Accordingly, back tension applied to a trailing end portion of the printing paper by the primary paper feed section or the secondary paper feed section is hardly transmitted to the leading end portion of the printing paper in contact with the printing drum (or the stencil), whereby generation of ghost or displacement of the stencil can be prevented.

Further, since the printing paper is delivered to the printing drum with the printing paper pinched by the paper feed roller pair, the paper feed roller pair need not be opened and accordingly, the mechanism for accurately controlling the timing of opening the paper feed roller pair may be eliminated, whereby the cost can be reduced.

When the paper feed roller pair are not opened and closed, generation of noise due to opening and closing of the roller pair can be prevented.

When the paper feed roller control means is provided with a speed changing means which controls the paper feed roller drive means to change the peripheral speed of the paper feed rollers, the printing papers can be conveyed at an optimal speed according to, for instance, the kind of the printing papers and the condition of the environment of the stencil printer, whereby the printing papers can be constantly conveyed stably irrespective of the kind of the printing papers, the condition of the environment of the stencil printer and the like.

When the sag in the printing paper becomes too large, the printing paper can be brought into contact with the printing drum and stained with ink before printing. This problem can be avoided by controlling the peripheral speed of the paper feed rollers so that the sag in the printing paper does not grow too large.

DESCRIPTION OF THE PREFERRED EMBODIMENTS

Figure 1:
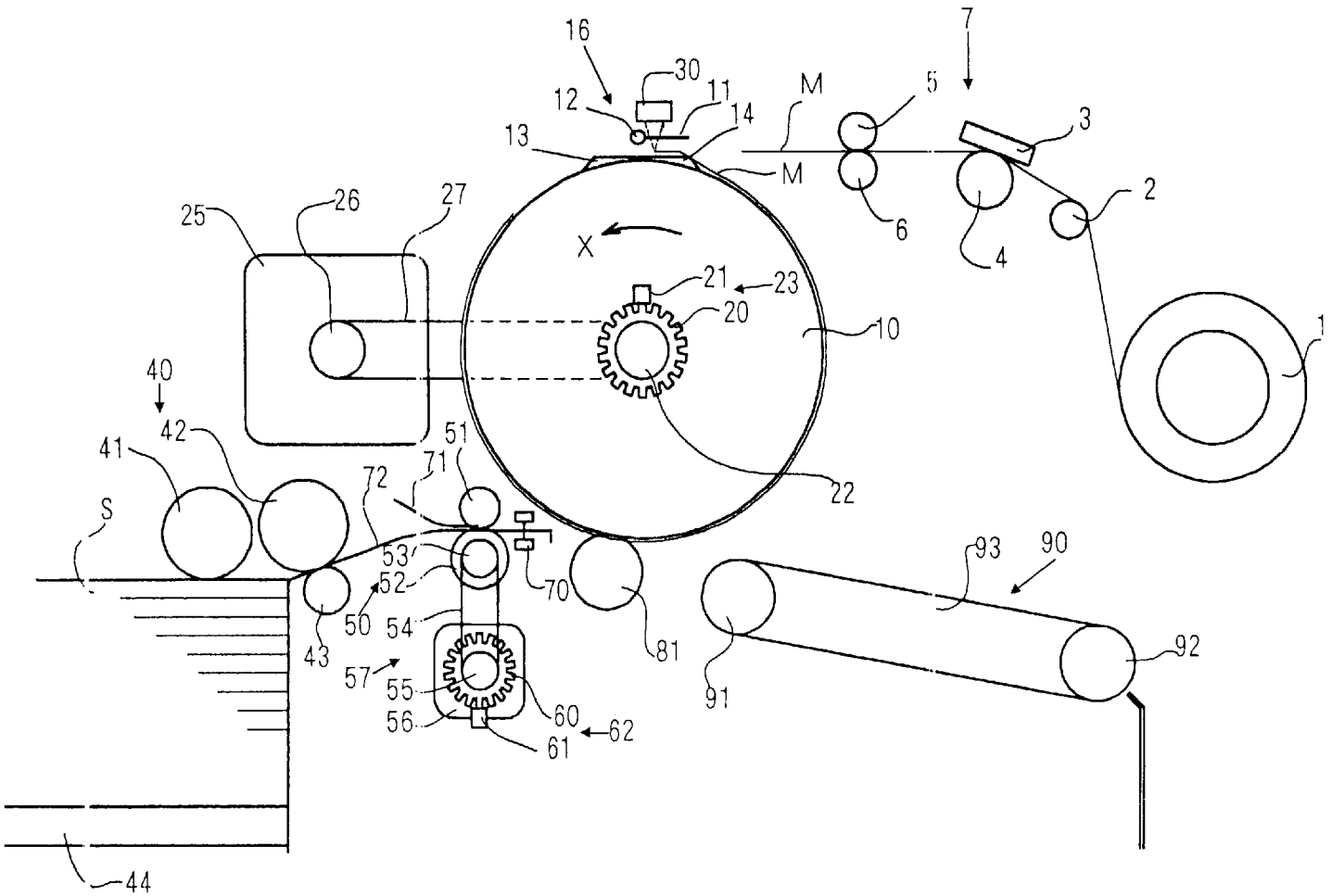
FIG. 1 is a schematic side view of a stencil printer in accordance with an embodiment of the present invention.

FIG. 1 shows a stencil printer in accordance with an embodiment of the present invention, where the present invention is applied to a stencil printer provided with a function of preventing shift of the printed image on the printing paper due to fluctuation in rotating speeds of the printing drum and the paper feed roller pair, slip of the printing paper relative to the paper feed roller pair, and shift of the stencil from the predetermined position.

In FIG. 1, a stencil printer in accordance with an embodiment of the present invention comprises a cylindrical printing drum 10, a press roller 81 which is pressed against the printing drum 10 and is rotatable in parallel to the printing drum 10, a primary paper feed section 40 which comprises a scraper roller 41, a pickup roller 42 and a separator roller 43 and feeds one printing paper from a stack S of printing papers on a paper feed table 44 each time the printing drum 10 makes one rotation, and a secondary paper feed section 50 which comprises a pair of register rollers 51 and 52 (paper feed roller pair), guide plates 71 and 72, and the like and inserts the printing paper, fed by the primary paper feed section 40, between the printing drum 10 and the press roller 81.

The printing drum 10 is rotated by a main motor 25 by way of a drive gear 26 formed on the output shaft of the main motor 25, a gear (not shown) formed on a rotary shaft 22 of the printing drum 10 and an endless belt 27 in mesh with the gears. A drum encoder 20 in the form of teeth formed on the circumferential surface of the rotary shaft 22 of the printing drum 10 at regular intervals and a photo sensor 21 which outputs a drum pulse each time it detects one of the teeth form a printing drum rotation detecting means 23. A clamp mechanism 16 for holding the leading end of the stencil M is provided on the printing drum 10 to extend along a generatrix of the circumferential surface thereof. A reference position detecting means (stencil sensor) 30 which detects a reference position on the printing drum 10 (in this particular embodiment, the leading end of the stencil M) from which the angular position of the printing drum 10 is measured is disposed near the clamp mechanism 16 separately from the printing drum 10.

By controlling rotation of the main motor 25 by the drum encoder 20 formed on the circumferential surface of the rotary shaft 22 of the printing drum 10 and the photo sensor 21, rotation of the printing drum 10 can be controlled without affected by backlash in the gears and the like.

A stencil making section 7 which comprises a guide roll 2, a thermal head 3, a platen roller 4 and a pair of conveyor rollers 5 and 6 and makes a stencil M by image-wise perforating a stencil material fed from a stencil material roll 1 is disposed near the printing drum 10.

Figure 2:
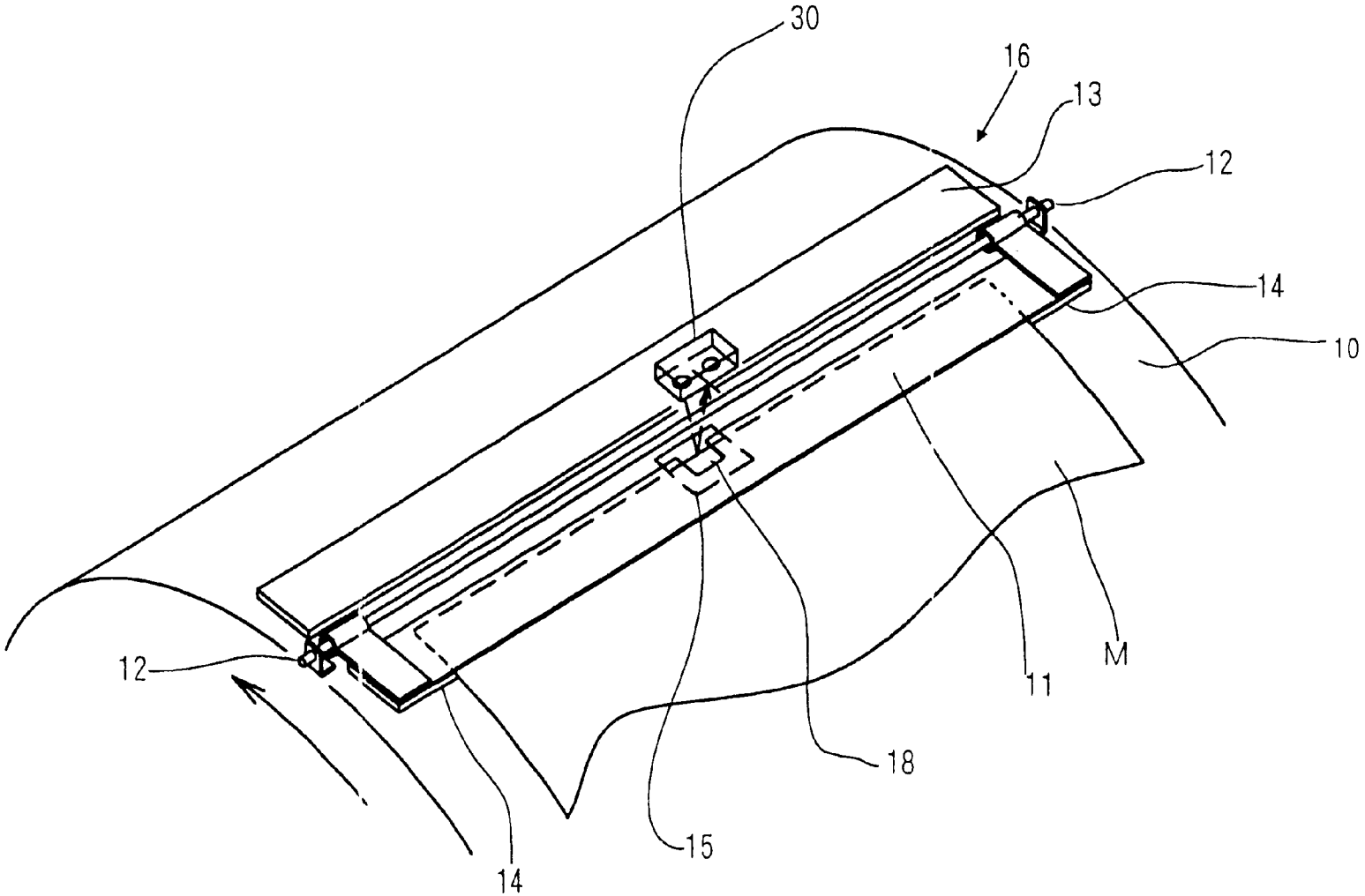
FIG. 2 is an enlarged perspective view showing in detail the clamp mechanism and the stencil sensor.

As shown in detail in FIG. 2, the clamp mechanism 16 comprises a magnetic clamp plate 11 fixed to a rotary pin 12 which extends along a generatrix of the printing drum 10 and is supported for rotation at opposite ends thereof, and a pair of retainer plates 14 and 13 which hold the clamp plate 11 under the magnetic force of the clamp plate 11 respectively in a clamping position or a closing position where the clamp plate 11 pinches the leading end of the stencil M together with the retainer plate 14 and an opening position where the clamp plate 11 releases the stencil M. A monitor window 18 is formed in the clamp plate 11 at a middle portion thereof. An anti-reflective region 15 is formed around the monitor window 18. The stencil sensor 30 comprises an LED and a photo sensor and the photo sensor receives light emitted from the LED and reflected at the surface of the leading end portion of the stencil M, thereby detecting the leading end of the stencil M. The anti-reflective region 15 prevents irregular reflection of the light emitted from the LED.

The register rollers 51 and 52 are interlocked with each other to rotate together in opposite directions by way of gears which are formed on opposite ends of the respective rollers and are in mesh with each other at each end. The register roller 52 is driven by a register roller drive means 57 comprising a register motor 56, a gear 53 formed on the rotating shaft of the register roller 52, a gear (not shown) formed on the output shaft 55 of the register motor 56 and an endless belt 54 in mesh with the gear 53 on the register roller 52 and the gear on the output shaft 55. A register encoder 60 in the form of teeth formed on the circumferential surface of the output shaft 55 of the register motor 56 at regular intervals and a photo sensor 61 which outputs a register pulse each time it detects one of the teeth form a register roller rotation detecting means 62 which detects information on rotation of the register roller 52 by way of information on rotation of the register motor 56. Preferably the register motor 56 is a DC servomotor.

Figure 3:
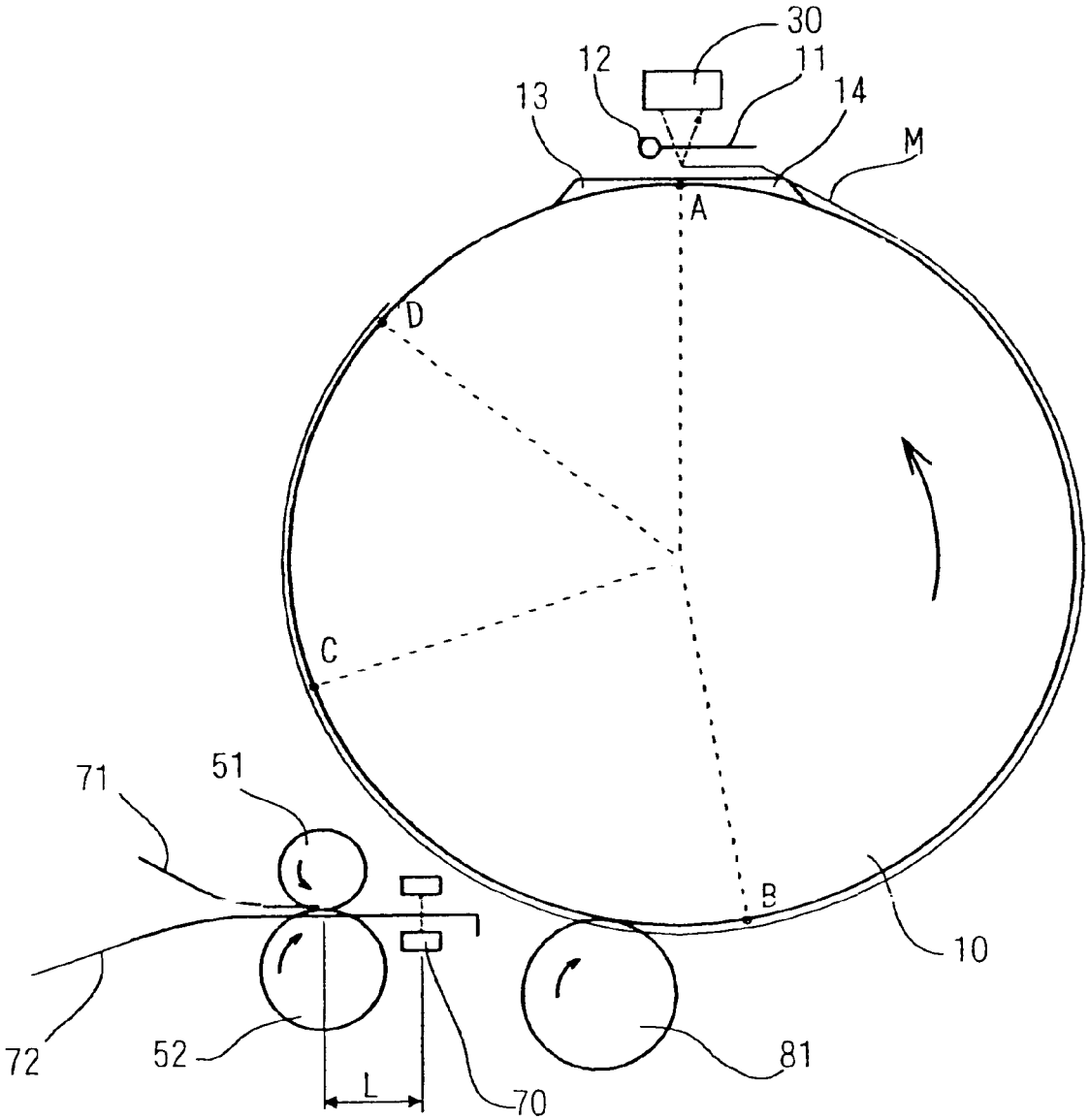
FIG. 3 is a schematic side view showing the printing drum, the press roller and the register rollers of the stencil printer.

Between the register rollers 51 and 52 and the press roller 81, there is disposed a register sensor (paper end detecting means) 70 which detects the leading end (as seen in the direction of conveyance of the printing paper) of the printing paper at a predetermined distance L from the register rollers 51 and 52 downstream thereof as shown in FIG. 3.

The stencil printer of this embodiment is provided with a control means 170 (FIG. 4) which controls a motor drive circuit 160 (FIG. 4) for driving the register motor 56 on the basis of drum rotation information detected by the printing drum rotation detecting means 23 and register roller rotation information detected by the register roller rotation detecting means 62.

On the downstream side of the press roller 81 as seen in the direction of conveyance of the printing paper, there is disposed a paper discharge section 90 which stacks printed papers removed from the printing drum 10. The paper discharge section 90 comprises a pair of suction rollers 91 and 92 and a suction belt 93 passed around the suction rollers 91 and 92.

Figure 4:
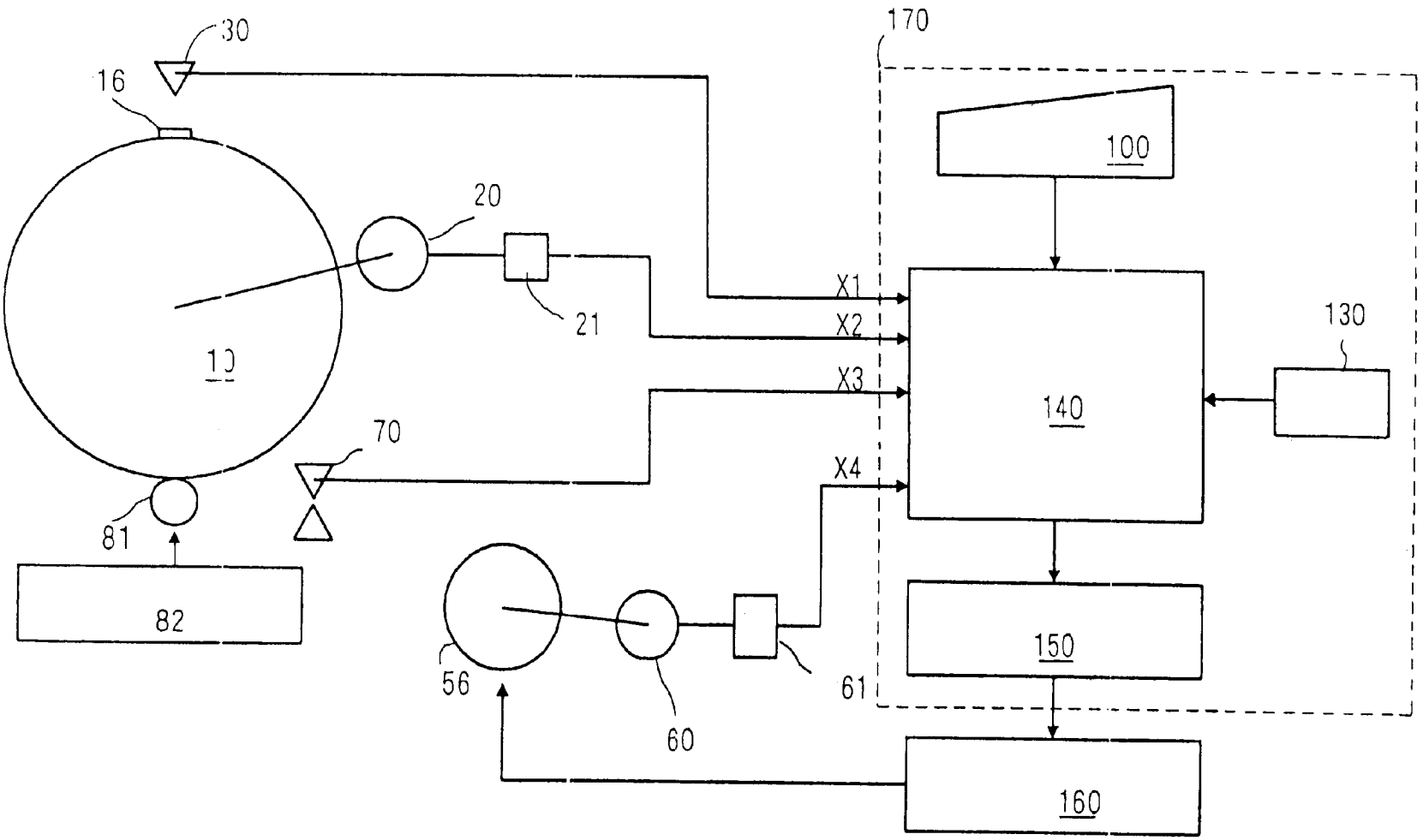
FIG. 4 is a block diagram showing the control means of the stencil printer.

FIG. 4 schematically shows the arrangement of the stencil printer of this embodiment. The control means 170 may comprise, for instance, a CPU which executes processing described later. Drum pulses X2 output from the photo sensor 21 of the printing drum rotation detecting means 23 and a reference pulse X1 output from the stencil sensor 30 upon detection of the leading end of the stencil M are input into a motor control circuit 140. The reference pulse X1 is detected each time the printing drum 10 makes one rotation and the number of the drum pulses X2 is counted from the time the reference pulse X1 is detected. That is, the number of the drum pulses X2 represents the angular position or the rotation-phase position of the printing drum 10. Register pulses X4 output from the photo sensor 61 of the register roller rotation detecting means 62 representing the rotation of the register motor 56, that is, the register rollers 51 and 52 are also input into the motor control circuit 140.

In the motor control circuit 140, the value NB of count of the drum pulses X2 at which the register motor 56 is to be started (this value NB will be referred to as "the register motor starting count NB", hereinbelow) is set in advance and the number of the drum pulses X2 reaches the register motor starting count NB, a PWM (pulse width modulator) signal generator 150 is started. The register motor starting count NB can be changed through a control panel 100. The PWM signal generator 150 starts the register motor 56 by way of the motor drive circuit 160, thereby driving the register rollers 51 and 52 to convey the printing paper. Thus the timing at which the leading end of the printing paper is to be inserted between the printing drum 10 and the press roller 81 can be controlled by changing the register motor starting count NB. In other words, the position of the printing paper relative to the stencil M in which the printing paper is brought into contact with the stencil M can be controlled by changing the register motor starting count NB. Further the motor control circuit 140 watches the register pulses X4 and controls the motor drive circuit 160 so that the rotating speed of the register motor 56 is kept in a predetermined relation (to be described later) with the rotating speed of the printing drum 10. With this arrangement, the "longitudinal registration" (adjustment of position of the printing paper relative to the image region of the stencil master in the direction of feed of the printing paper) can be carried out by changing the register motor starting count NB. Further since the number of the drum pulses X2 is counted from the position of the leading end of the stencil M, the position of the printing paper relative to the stencil M can be kept unchanged even if the leading end of the stencil M is shifted relative to the printing drum 10 in the direction opposite to the direction of rotation of the printing drum 10.

After the printing paper is inserted between the printing drum 10 and the press roller 81, the rotating speed of the register motor 56 is controlled to a preset value so that the peripheral speed of the register rollers 51 and 52 becomes higher than that of the printing drum 10. The preset value of the rotating speed of the register motor 56 has been stored in a memory 130.

A paper end pulse X3 which is output from the register sensor 70 upon detection of the leading end of the printing paper is also input into the motor control circuit 140. When the paper end pulse X3 is not detected by a predetermined time, which occurs when slip of the printing paper occurs during conveyance, the motor control circuit 140 controls the register motor 56 by way of the motor drive circuit 160 so that the delay in conveyance of the printing paper due to slip is compensated for and the printing paper meets the stencil M in the preset position relative to the stencil M. Thus shift of the printing paper relative to the stencil M due to slip of the printing paper during conveyance, which cannot be dealt with by simply controlling the rotating speed of the register roller 51 and 52 relative to the rotating speed of the printing drum 10, can be prevented.

Figure 5:
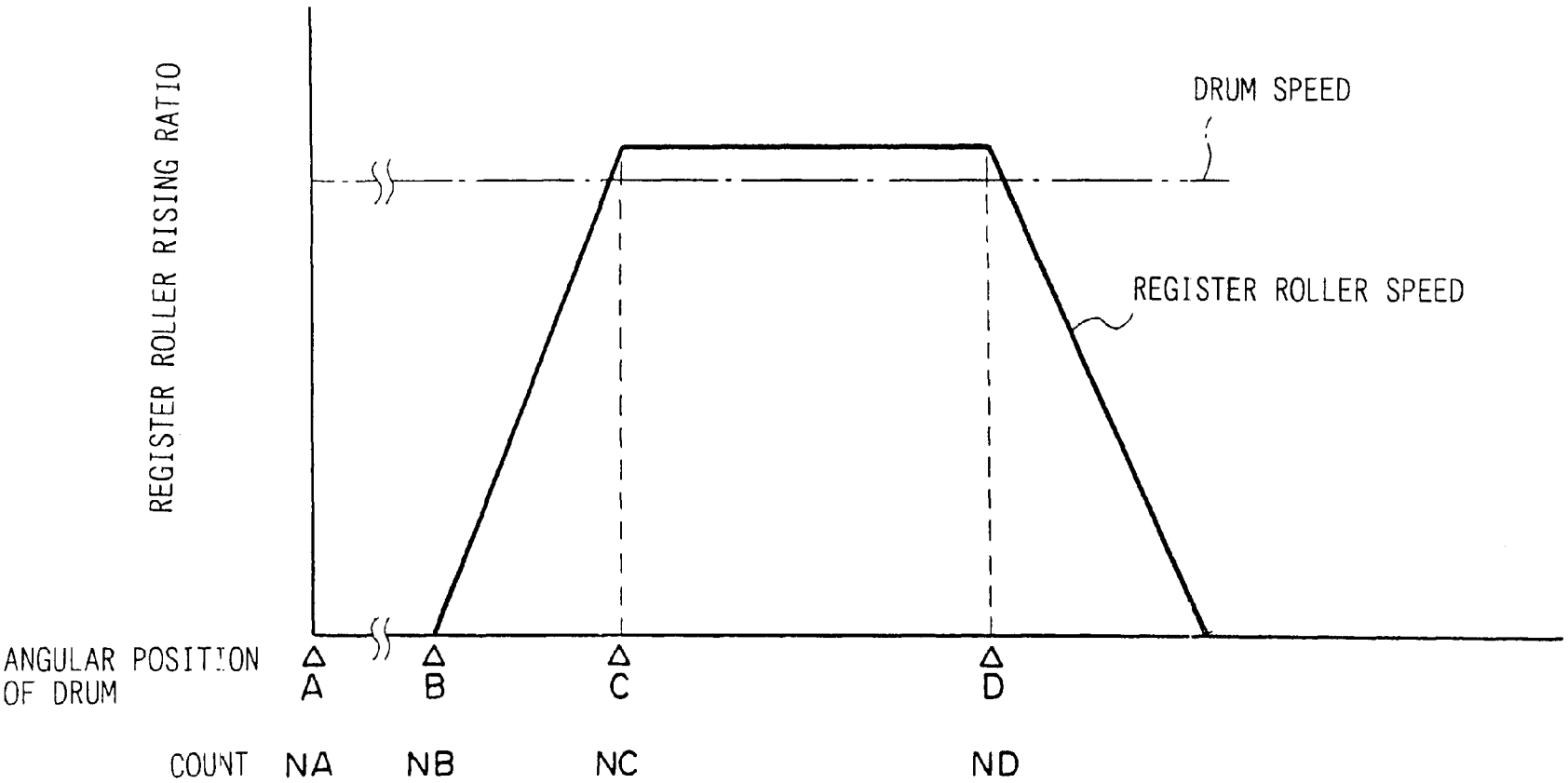
FIG. 5 is a chart for illustrating the operation of the stencil printer.
Figure 6:
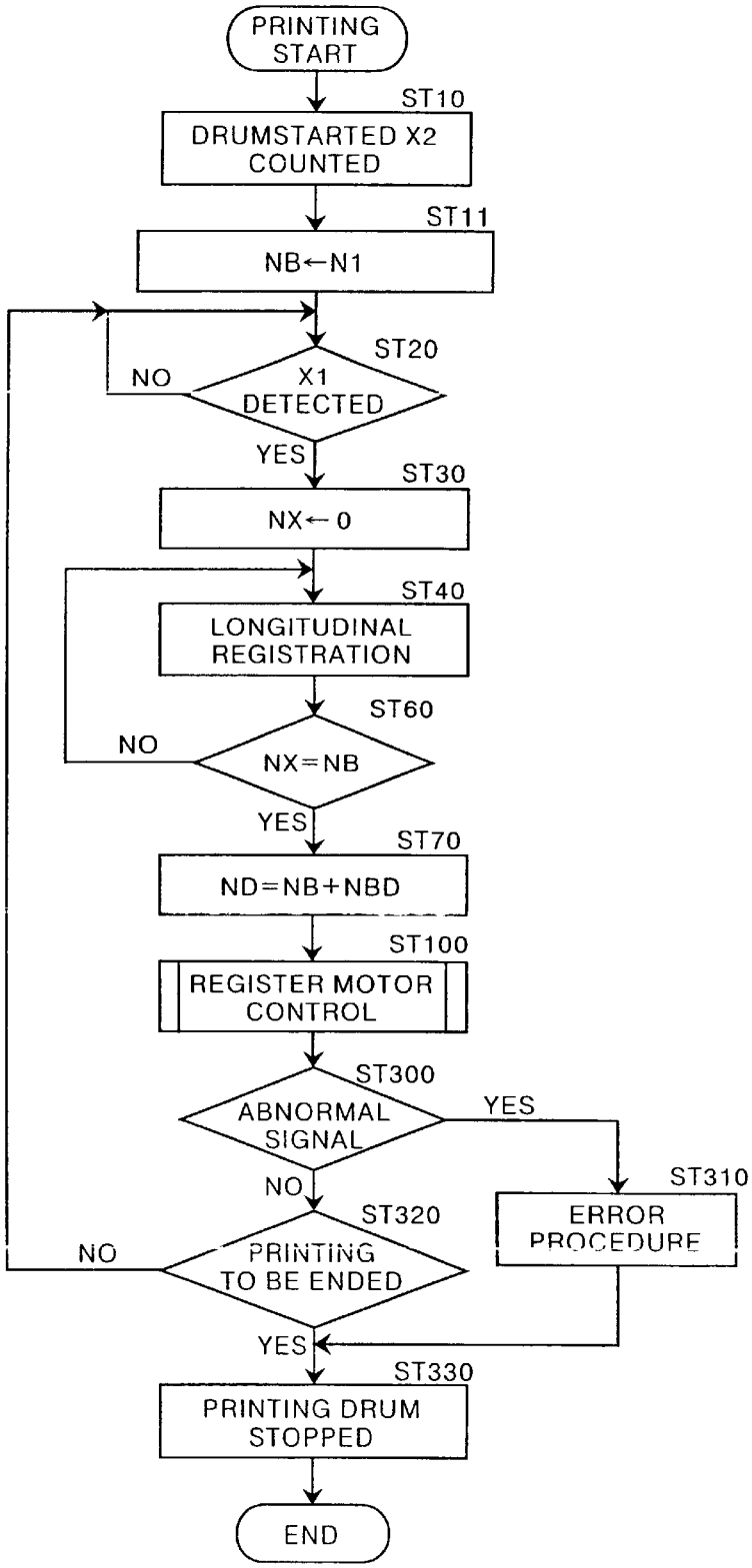
FIG. 6 is a flow chart for illustrating the main processing to be executed by the control means.

The operation of the stencil printer of this embodiment will be described with reference to FIGS. 5 and 6, hereinbelow.

First the stencil making process will be described. In the stencil making section 7 (FIG. 1), the stencil material is fed out from the stencil material roll 1 and conveyed between the thermal head 3 and the platen roller 4 guided by the guide roller 2. While the stencil material travels between the thermal head 3 and the platen roller 4, the thermal head 3 image-wise thermally perforate the stencil material according to an image signal input from an image read-out section (not shown), thereby making a stencil M. At this time, the conveyor rollers 5 and 6 are kept stopped and the stencil M is temporarily stored in a storage box (not shown) disposed between the conveyor rollers 5 and 6 and the thermal head 3.

Then the printing drum 10 is rotated to the stencil mounting position shown in FIG. 1 and the clamp plate 11 is moved to the opening position where it is on the retainer plate 13. In this state, the conveyor rollers 5 and 6 are started to convey the stencil M. The conveyor rollers 5 and 6 are driven by a stepping motor (not shown) and the stepping motor is driven by a predetermined number of pulses so that the leading end of the stencil M is stopped in a predetermined position. After the leading end of the stencil M is stopped in the predetermined position, the clamp plate 11 is rotated to the clamping position where it abuts against the retainer plate 14 with the leading end portion of the stencil M pinched therebetween. Then the main motor 25 is energized to rotate the printing drum 10 in the direction of arrow X at a low speed and when the printing drum 10 is rotated by a predetermined angle, the stencil M is severed from the stencil material in a continuous length, whereby the stencil M is wound around the printing drum 10. The stencil sensor 30 detects the leading end of the stencil M through the monitor window 18 in the clamp plate 11.

The printing operation of the stencil printer of this embodiment will be described with reference to the flow chart shown in FIG. 6, hereinbelow.

The main motor 25 is started to rotate the printing drum 10 and count of the drum pulses X2 is started (step ST10), and then the register motor starting count NB is set to a standard value N1 (step ST11). When a reference pulse X1 from the stencil sensor 30 is detected, that is, when the leading end of the stencil M is in position A (FIG. 3) just below the stencil sensor 30, the count NX of the drum pulses X2 is once cleared. (steps ST20 and ST30) Then count of the drum pulses X2 is resumed. That is, the position of the leading end of the stencil M is set as a reference position on the basis of which the angular position and the rotating speed of the printing drum 10 are measured. The angular position of the printing drum 10 can be known as the number of the drum pulses X2 detected after detection of reference pulse X1 output from the stencil sensor 30 and the rotating speed of the printing drum 10 can be known from the period of one drum pulse X2. By detecting the angular position of the printing drum 10 in this manner, the position of the printing paper relative to the stencil M, i.e., "longitudinal registration", can be kept as set initially even if the stencil M is shifted from the original position during printing.

The register motor starting count NB which governs the longitudinal registration can be changed by inputting an adjustment value through the control panel 100 as described above. Step ST 40 is executed only when an adjustment value is input through the control panel 100 and is normally passed.

In response to start of the main motor 25 (step ST 10), the primary paper feed section 40 is driven by the main motor 25 by way of a transmission mechanism which is not shown and may be of the conventional structure and the uppermost printing paper in the stack S of the printing papers is separated from the stack S and is brought into abutment against the contact line of the register rollers 51 and 52 which are kept stopped at this time, whereby the printing paper sags along the guide plate 71.

Figure 7:
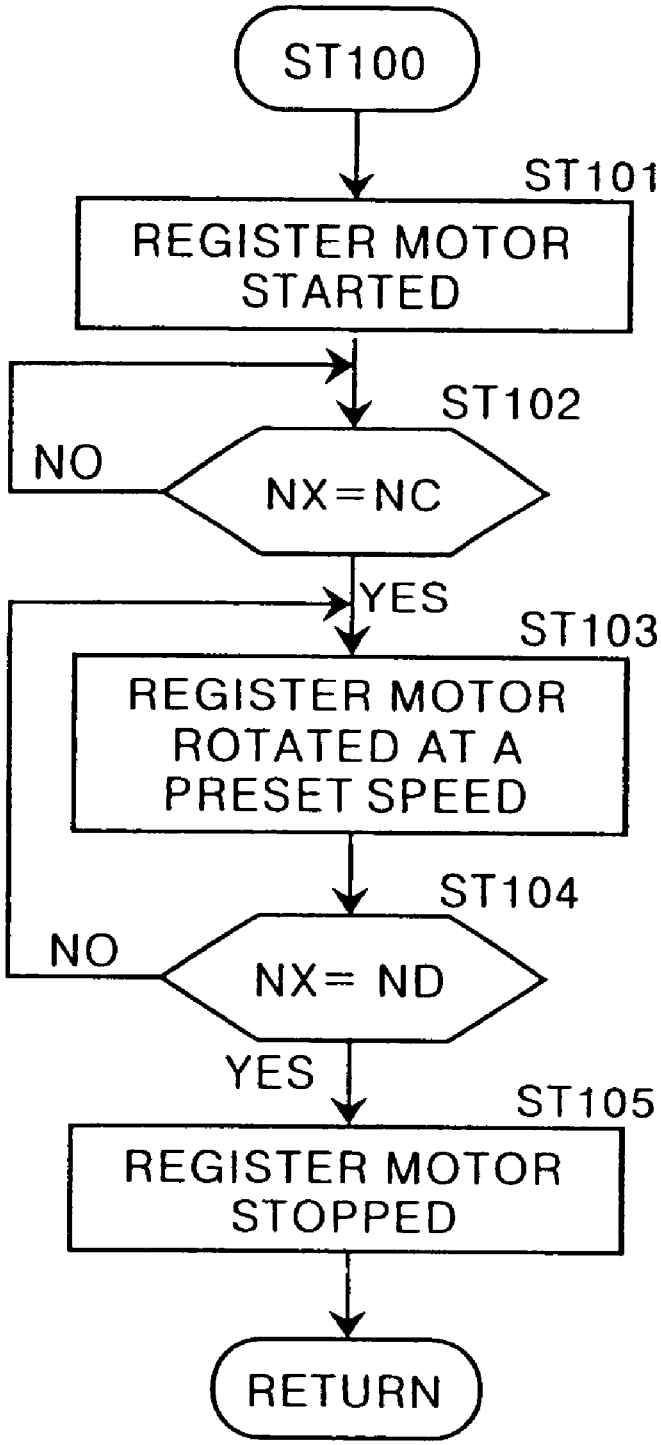
FIG. 7 is a flow chart for illustrating the register motor control processing.

When the count NX of the drum pulses X2, that is, the number of the drum pulses X2 counted from the time the reference pulse X1 is detected, reaches the register motor starting count NB (step ST60), the register motor 56 is started to rotate the register rollers 51 and 52. In FIG. 3, when the printing drum 10 is rotated by an angle corresponding to arc AB after detection of the reference pulse X1 (when the point on the printing drum 10 which is in position B when the leading end of the stencil M is in the position A reaches the position A: this time point will be referred to as "time point B", hereinbelow), the register motor 56 is started to rotate the register rollers 51 and 52. That is, the register motor starting count NB corresponds to rotation of the printing drum which carries the leading end of the stencil M to a position distant from the position A in the counterclockwise direction by an angle equal to the angle corresponding to arc AB. When the printing drum 10 is rotated by the angle corresponding to arc BD after time point B, the register motor 56 is stopped. The number of the drum pulses X2 corresponding to rotation of the printing drum 10 by the angle corresponding arc BD will be referred to as "the operating count NBD", hereinbelow. The register motor starting count NB is variable as described above whereas the operating count NBD is generally fixed. In step ST70, the sum of the register motor starting count NB and the operating count NBD is set as a register motor stopping count NG at which the register motor 56 is to be stopped. Then the register motor 56 is controlled so that rotation of the register rollers 51 and 52 are synchronized with rotation of the printing drum 10, that is, so that the register rollers 51 and 52 are in a predetermined relation with the printing drum 10 with respect to the rotating speed and the angular position. (step ST100: the register motor control sub-routine shown in FIG. 7 to be described later) This control of the register rollers 51 and 52 will be described in detail referring also to FIG. 7, hereinbelow.

When the count NX of the drum pulses X2 reaches NC corresponding to rotation of the printing drum 10 by the angle corresponding to arc AC (FIG. 3) after the register motor 56 is started (ST 101 in FIG. 7), that is, when the leading end of the printing paper reaches the contact line of the printing drum 10 and the press roller 81, the register motor 56 is caused to rotate at a preset speed stored in the memory 130 so that the peripheral speed of the register rollers 51 and 52 becomes higher than that of the printing drum 10. (steps ST102 and ST103).

When the leading end of the printing paper reaches the contact line of the press roller 81 and the printing drum 10, the printing paper comes to be conveyed pinched by the press roller 81 and the printing drum 10. Since the printing paper is conveyed by the register rollers 51 and 52 at a higher speed than by the printing drum 10 and the press roller 81, the printing paper is conveyed with sag formed between the register rollers 51 and 52 and the printing drum 10. Accordingly, tension hardly acts on the stencil M on the printing drum 10. While the printing paper is conveyed by the printing drum 10 and the press roller 81 with the printing paper pressed against the stencil M on the printing drum 10 by the press roller 81, ink supplied from an ink supply mechanism (not shown) disposed inside the printing drum 10 is transferred to the printing paper through the perforations in the stencil M, whereby a print is made.

When the count NX of the drum pulses X2 reaches the register motor stopping count ND, the register motor 56 is stopped. (steps S104 and S105)

When an abnormal signal is generated during the register motor control sub-routine, a press roller solenoid 90 (FIG. 4) is actuated to move the press roller 81 away from the printing drum 10 and the register rollers 51 and 52 are kept rotated to discharge the printing paper (error procedure). (steps ST300 and ST310) Thereafter the printing drum 10 is stopped. (step ST330) This is because if the printing operation is continued despite that no printing paper reaches the press roller 81, the press roller 81 is stained with ink. It is preferred that an warning be provided as a display on the control panel 100 and/or sound.

The printed paper is peeled off the printing drum 10 by a scraper (not shown) disposed between the suction roller 91 and the printing drum 10 and conveyed by the suction belt 93 to be stacked in the paper discharge section 90.

These steps are repeated until a predetermined number of printing papers are printed (step ST320) and thereafter the printing drum 10 is stopped (step ST330).

As can be understood from the description above, in the stencil printer of this embodiment, the printing paper is delivered to the printing drum 10 with the printing paper pinched by the register roller 51 and 52 which are rotating at a peripheral speed higher than that of the printing drum 10. Accordingly, the printing paper is conveyed with sag formed between the paper feed roller pair and the printing drum, and back tension applied to a trailing end portion of the printing paper by the primary paper feed section 40 or the secondary paper feed section 50 is hardly transmitted to the leading end portion of the printing paper in contact with the printing drum 10 (or the stencil), whereby generation of ghost or displacement of the stencil can be prevented.

Further, since the printing paper is delivered to the printing drum 10 with the printing paper pinched by the register roller 51 and 52, the register rollers 51 and 52 need not be opened and accordingly, the mechanism for accurately controlling the timing of opening the register rollers 51 and 52 may be eliminated, whereby the cost can be reduced.

Further, generation of noise due to opening and closing of the register rollers 51 and 52 can be prevented.

The paper conveying rate for a given speed of the register rollers 51 and 52 varies according to the kind of the printing paper and the diameter of the register rollers 51 and 52 which changes with the temperature of the environment. Though, in the embodiment described above, the speed at which the speed of the register rollers 51 and 52 are set so that their peripheral speed becomes higher than that of the printing drum 10 when the printing paper is to be delivered to the printing drum 10 and the press roller 81 is fixed to one speed, the speed may be changed according to the kind of the printing paper, the temperature of the environment and the like. In such a case, a plurality of speeds are set according to the kind of the printing paper, the temperature of the environment or the like and are stored in the memory 130 in advance. One of the speeds is selected according to the kind of the printing paper, or the temperature of the environment detected, for instance, by a thermistor disposed near the register rollers 51 and 52.

Figure 8:
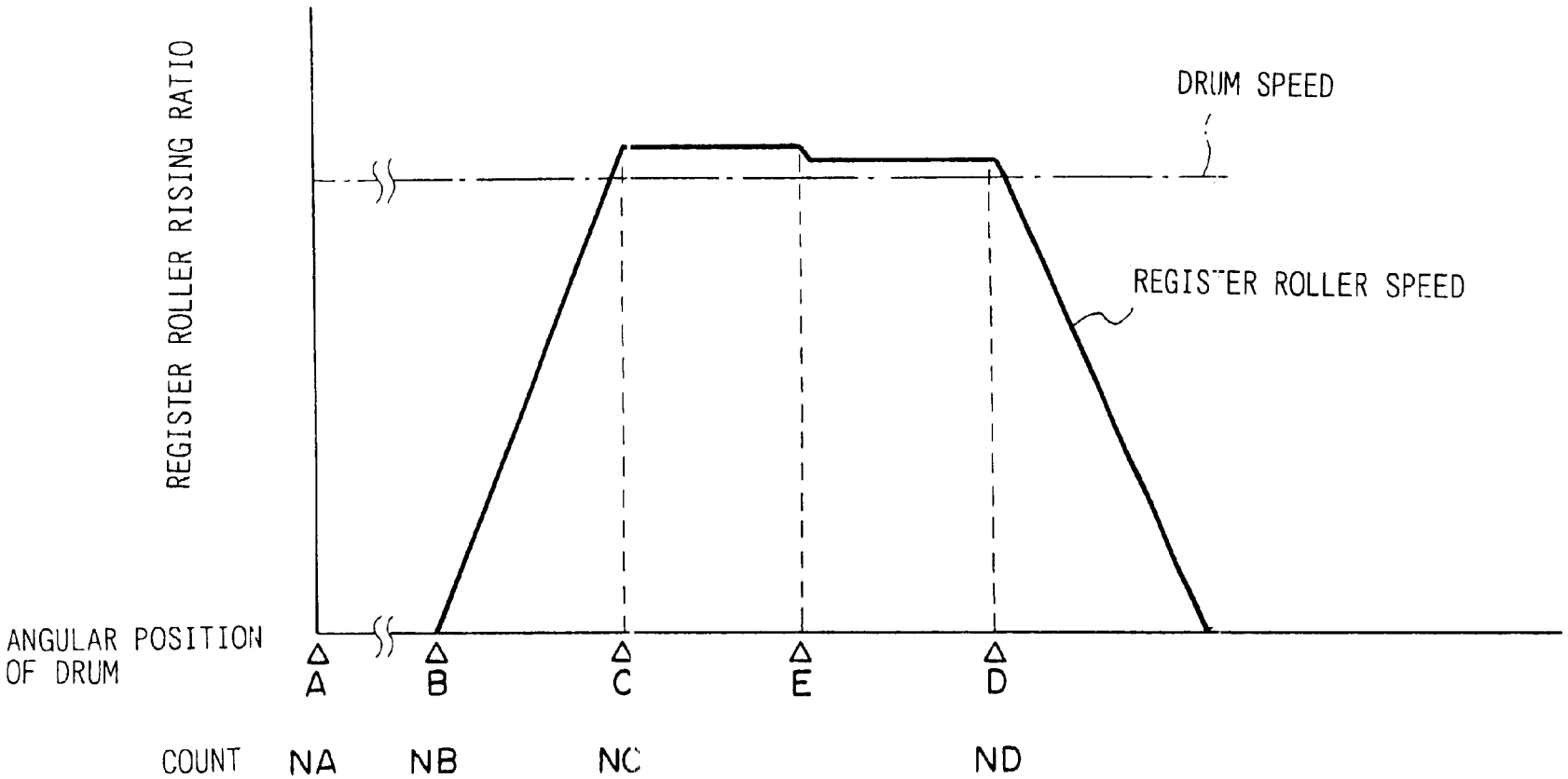
FIG. 8 is a chart for illustrating a modification of the operation of the stencil printer.
Figure 9:
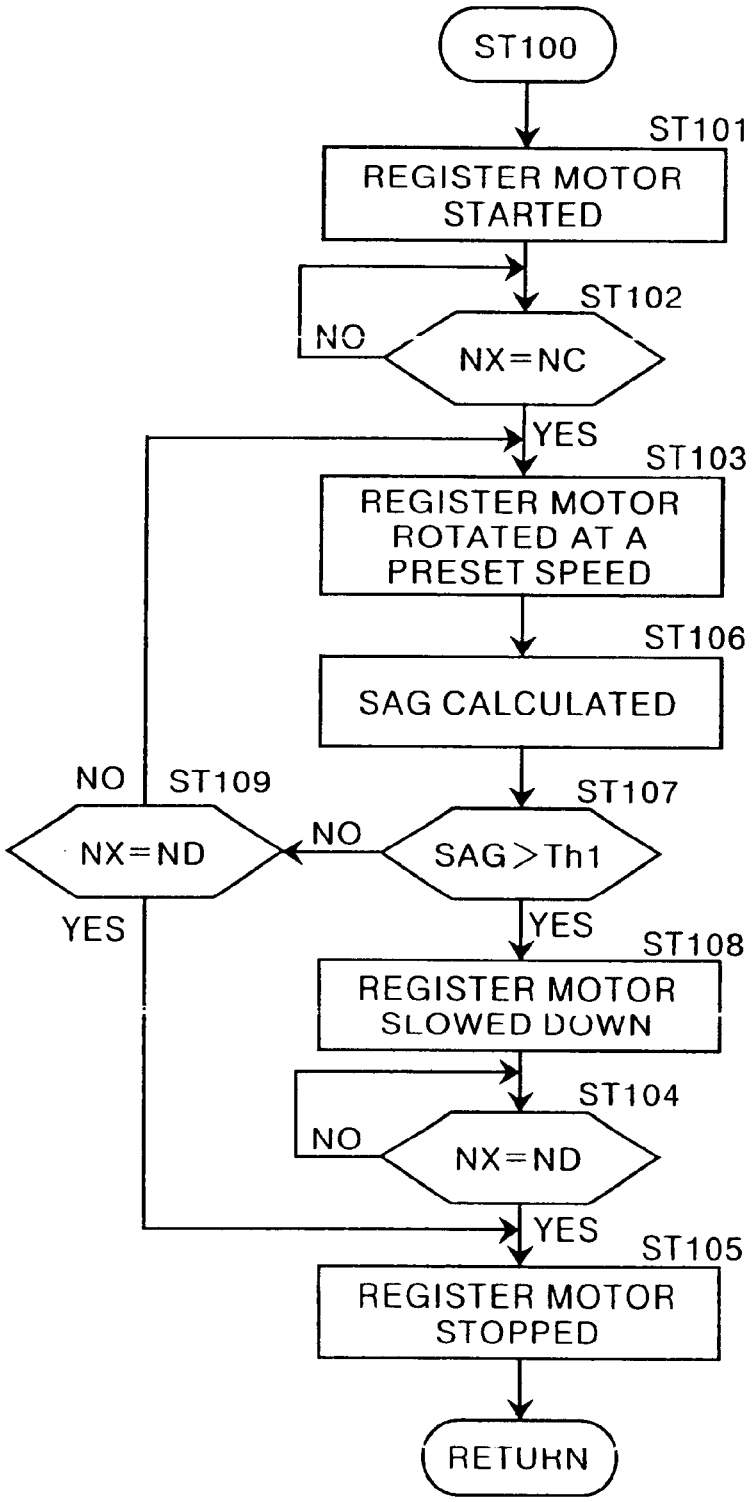
FIG. 9 is a flow chart for illustrating the register motor control processing in a stencil printer in accordance with another embodiment of the present invention.

When the sag in the printing paper becomes too large, the printing paper can be brought into contact with the printing drum 10 and stained with ink before printing. This problem can be avoided by controlling the peripheral speed of the paper feed rollers so that the sag in the printing paper does not grow too large. A stencil printer in accordance with another embodiment of the present invention where the rotating speed of the register rollers 51 and 52 is changed according the amount of sag in the printing paper will be described with reference to FIGS. 8 and 9, hereinbelow.

In this embodiment, the amount of sag in the printing paper is calculated, on the basis of the rotating speed of the printing drum 10, the rotating speed of the register rollers 51 and 52 and the time from the time the leading end of the printing paper reaches the printing drum 10, after the register motor 56 is caused to rotate at a preset speed stored in the memory 130 so that the peripheral speed of the register rollers 51 and 52 becomes higher than that of the printing drum 10 in step ST103. (Step ST106 in FIG. 9) When the amount of sag exceeds a threshold value Th1, the register motor 56 is slowed down. (steps ST107 and ST108) The time at which the amount of sag exceeds the threshold value Th1 corresponds to the angular position of the printing drum 10 indicated at E in FIG. 8.

Figure 10:
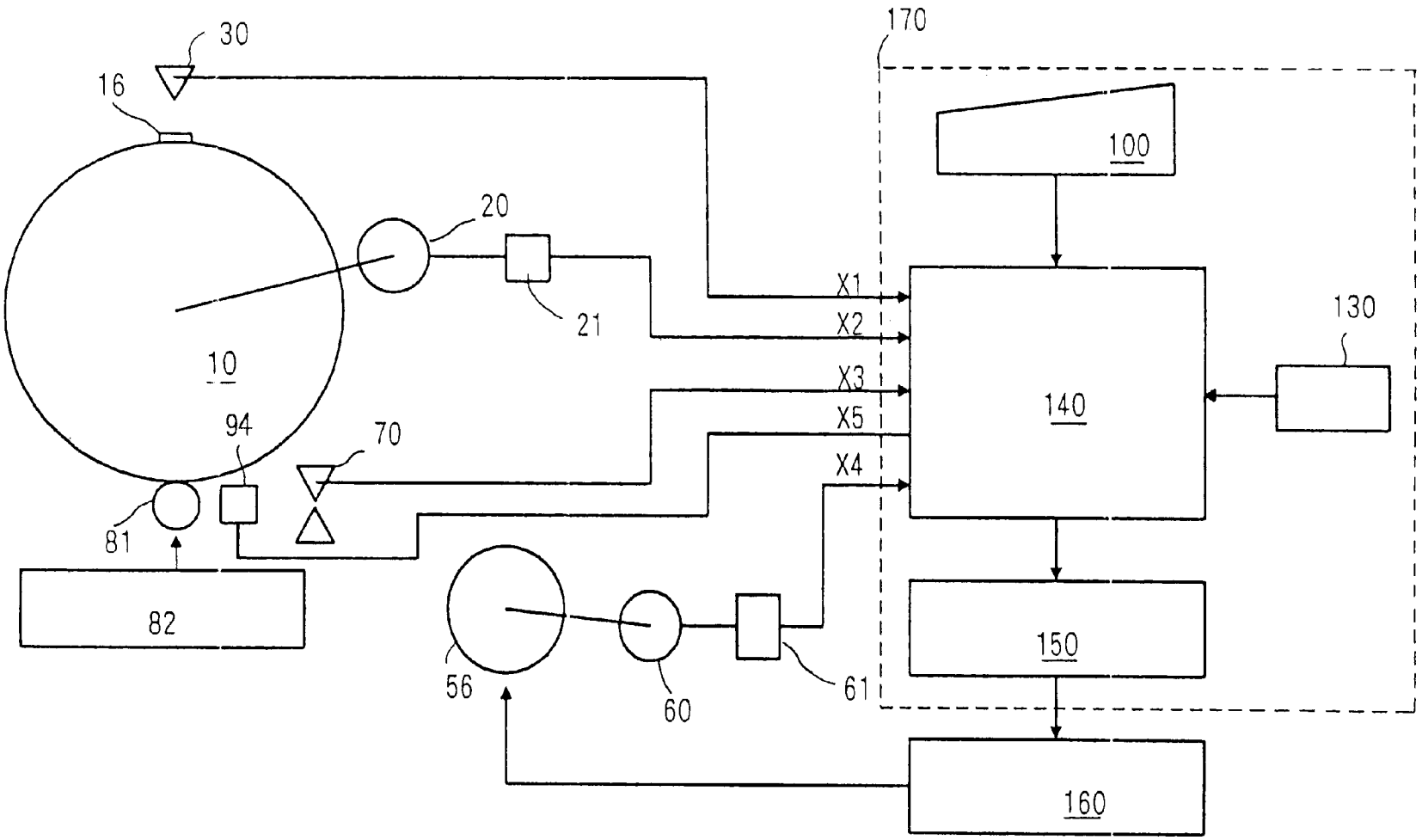
FIG. 10 is a block diagram showing a modification of the control means.

Instead of calculating the amount of sag on the basis of the rotating speed of the printing drum 10, the rotating speed of the register rollers 51 and 52 and the time from the time the leading end of the printing paper reaches the printing drum 10, the amount of sag may detected by a sag sensor. For example, as shown in FIG. 10, a sag sensor 94 is provided to detect the amount of sag in the printing paper between the register rollers 51 and 52 and the printing drum 10. A detecting signal X5 representing the amount of sag detected by the sag sensor 94 is input into the motor control circuit 140 and the motor control circuit 140 slows down the register motor 56 when the amount of sag as represented by the signal X5 exceeds the threshold value Th1. The sag sensor 94 may be disposed in a position similar to the register sensor 70.

As the sag sensor 94, a reflective analog sensor or an analog sensor with an actuator may be employed. When a reflective analog sensor is employed, the amount of light reflected at the surface of the printing paper changes according to the amount of sag in the printing paper. Accordingly, the amount of sag in the printing paper can be detected on the basis of the amount of light reflected at the surface of the printing paper. The relation between the amount of light reflected at the surface of the printing paper and the amount of sag may be stored in the memory 130 in advance and the amount of sag may be determined on the basis of the relation. When an analog sensor with an actuator is employed, the actuator is pushed by the sag of the printing paper, and accordingly, the amount of sag may be detected on the basis of movement of the actuator. The relation between the movement of the actuator and the amount of sag may be stored in the memory 130 in advance and the amount of sag may be determined on the basis of the relation.

When the sag sensor 91 is employed and the amount of sag is continuously detected, the rotating speed of the register motor 56 may be controlled on the basis of the signal X5 so that the amount of sag is fixed after the amount of sag exceeds the threshold value Th1.

What is claimed is:

1. A stencil printer comprising a printing drum which is rotated bearing a stencil wound around the printing drum, a pair of paper feed rollers which are rotated in contact with each other to feed a printing paper inserted therebetween and supply it to the printing drum, a pressing roller means which is rotated in contact with the printing drum to convey the printing paper supplied to the printing drum with the printing paper pressed against the stencil on the printing drum, a paper feed roller drive means which drives the paper feed rollers, and a paper feed roller control means which controls the paper feed roller drive means to rotate the paper feed rollers at a peripheral speed higher than that of the printing drum at least from the time at which the leading end of the printing paper reaches the printing drum to the time at which the trailing end of the printing paper passes the paper feed rollers.

2. A stencil printer as defined in claim 1 in which the paper feed roller control means is provided with a speed changing means which controls the paper feed roller drive means to change the peripheral speed of the paper feed rollers.

3. A stencil printer as defined in claim 2 in which the speed changing means controls the paper feed roller drive means to change the peripheral speed of the paper feed rollers according to the paper conveying rate of the paper feed rollers.

4. A stencil printer as defined in claim 2 in which the speed changing means is provided with a sag detecting means which detects the amount of sag of the printing paper between the paper feed rollers and the printing drum and controls the paper feed roller drive means to change the peripheral speed of the paper feed rollers according to the amount of sag.

* * * * *